United States Patent [19]

Ditchek et al.

[11] Patent Number: 4,537,323

[45] Date of Patent: Aug. 27, 1985

[54] MO-TI MEMBERS WITH NON-METALLIC SINTERING AIDS

[75] Inventors: Brian M. Ditchek, Milford; Thomas R. Middleton, Peabody, both of Mass.

[73] Assignee: GTE Laboratories Incorporated, Waltham, Mass.

[21] Appl. No.: 568,995

[22] Filed: Jan. 9, 1984

[51] Int. Cl.[3] ..... C22C 1/10; H01J 61/36

[52] U.S. Cl. ..... 220/2.1 R; 75/230; 75/232; 75/233; 75/234; 75/235; 75/244; 419/12; 419/19; 419/38; 419/45

[58] Field of Search ..... 75/232, 233, 234, 235, 75/244, 230; 419/12, 19, 38, 45; 220/2.1 R

[56] References Cited

U.S. PATENT DOCUMENTS 4,334,628 6/1982 Buhrer et al. ..... 220/2.1 R
4,366,410 12/1982 Buhrer ..... 220/2.1 R

*Primary Examiner*—Allan M. Lieberman
*Attorney, Agent, or Firm*—J. Stephen Yeo

[57] ABSTRACT

Boron, oxygen, or a mixture thereof, is used as a sintering aid in sintering Mo-Ti alloys. Compounds formed between these sintering aids and the Mo or Ti have thermal expansion coefficients consistent with that of alloys of Mo and Ti. An hermetic member may be made using these constituents. The hermetic member may be used to seal an assembly such as a high pressure sodium lamp.

28 Claims, 1 Drawing Figure

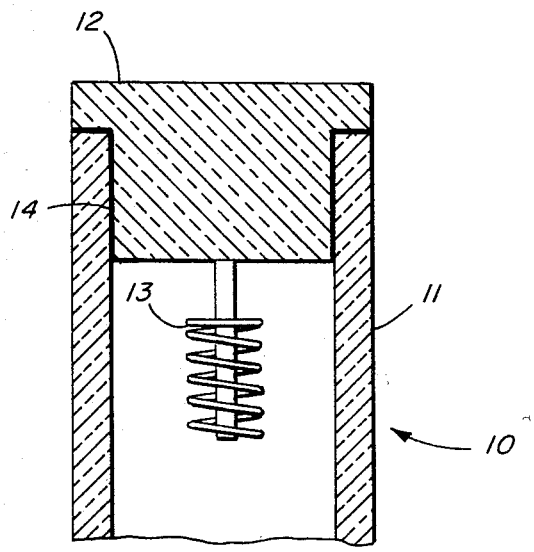
12
14
13
11
10

MO-TI MEMBERS WITH NON-METALLIC SINTERING AIDS

REFERENCE TO RELATED PATENTS

U.S. Pat. No. 4,334,628 for "Vacuum-Tight Assembly" issued to Carl F. Buhrer and Alfred E. Feuersanger and U.S. Pat. No. 4,366,410 for "Vacuum-Tight Assembly Particularly for a Discharge Tube" issued to Carl F. Buhrer are hereby incorporated by reference.

BACKGROUND OF THE INVENTION

This invention pertains to molybdenum-titanium hermetic members having a thermal expansion coefficient compatible with alumina and other ceramics, and more particularly is concerned with sintering aids for such members.

Electrical discharge devices, such as high pressure sodium vapor arc lamps, commonly utilize transparent or translucent high temperature refractory tubes composed of alumina, yttria, or other ceramics. In the case of an arc lamp, an electric arc extends between two tungsten electrodes within the tube. Current is conducted to the electrodes through the ends of the tube by hermetically sealed feedthrough assemblies. Niobium (Nb) members have been used for this purpose as alumina and niobium have nearly equal thermal coefficients of expansion. The joint between the Nb metal and the alumina is typically filled with a meltable frit based on calcium aluminate and fired. The feedthrough assembly not only conducts electrical current through the end of the tube, but also seals the discharge tube.

While Nb is physically satisfactory as a closure member for ceramic tubes, it is a relatively expensive metal and is in potentially short supply under certain world conditions.

U.S. Pat. No. 4,366,410 divulges an alternate approach wherein the niobium is replaced with a solid solution of molybdenum and titanium. This alloy has a thermal expansion coefficient matched to the ceramic tube. U.S. Pat. No. 4,334,628 teaches the use of metallic sintering aids selected from the group consisting of nickel, cobalt, and copper (Ni, Co, Cu), and mixtures thereof. These metallic elements react with titanium to form intermetallic compounds (e.g., $Ti_2Ni$ in the case of Ni) which melt at a lower temperature than the sintering temperature of the Mo-Ti alloy alone and, therefore, promotes sintering to hermeticity. Unfortunately, the phases of the intermetallics may have thermal expansion coefficients that are considerably higher than that of single-phase solid solutions of Mo-Ti. When the lamp is energized, the feedthrough temperature rises from room temperature to 800° C. A large difference between the thermal expansion coefficients can lead to stresses and cracking, eventually causing the feedthrough member to lose its vacuum-tight property.

SUMMARY OF THE INVENTION

As an aspect of the invention, boron, oxygen, or a mixture thereof, is added as a sintering aid to a mixture of titanium and molybdenum prior to sintering. The resulting sintered member is characterized by having an approximately uniform thermal expansion coefficient.

BRIEF DESCRIPTION OF THE DRAWING

The single drawing illustrates a discharge lamp having an end member embodying an aspect of the invention.

For a better understanding of the present invention, together with other and further objects, advantages, and capabilities thereof, reference is made to the following disclosure and appended claims in connection with the above-described drawing.

DESCRIPTION OF THE INVENTION

The drawing shows an example of a discharge device which embodies an aspect of the invention. One end of a high pressure sodium vapor discharge lamp 10 is shown. Lamp 10 has a tube 11 made of alumina, yttria, or other suitable ceramic. At the end of the tube there is positioned an electrode 13. A hermetic member 12 at each end supports an electrode 13 and seals the corresponding end of tube 11. A frit interface 14 may be used. The hermetic member 12 is made of a solid solution of molybdenum and titanium having a thermal expansion coefficient about the same as the ceramic.

Polycrystalline alumina has a thermal expansion coefficient of $81\times10^{-7}$/°C. Yttria has a thermal expansion coefficient of $78\times10^{-7}$/°C. A solid solution of molybdenum and titanium can be made to have a thermal expansion coefficient in the range of $55\times10^{-7}$/°C. to $90\times10^{-7}$/°C. by adjusting the proportions of Mo and Ti. A solid solution having a Mo to Ti w/o ratio of 2.96 for example has a thermal expansion coefficient matching that of alumina. This ratio of Mo and Ti has a melting temperature of about 2200° C. if a sintering aid is not used.

As a feature of the invention non-metallic sintering aids are added to a Mo-Ti blend to reduce the sintering temperature to about 1900° C. The specific non-metallic sintering aids of the invention are boron, oxygen (B, O), and combinations thereof. These aids yield phases that have thermal expansion coefficients that are within the range of values possible in the Mo-Ti system.

Boron when added to the Mo-Ti alloy yields an additive phase of TiB, the thermal expansion coefficient of the second phase is comparable with that of an equimolar mixture of Mo and Ti.

A similar result occurs with oxygen. Oxides of titanium have lower thermal expansion coefficients than the titanium itself. The thermal expansion coefficient (between 25° C. and 800°C.) of Ti and $TiO_2$ is $105\times10^{-7}$/°C. and $89\times10^{-7}$/°C., respectively. Thermal expansion coefficients of intermediate Ti oxides, such as $Ti_2O$ and TiO, which are the additive phases formed when oxygen is used as an additive, have thermal expansion coefficients somewhere between these values.

The three additive phases, TiB, $Ti_2O$, and TiO, all yield a melt in the range of temperatures between 1670° C. and 1770° C. As a result, above these temperatures sintering is promoted by a liquid phase mechanism. Such a sinter yields a high density hermetic body in Mo-Ti alloys with or without metallic sintering aids.

As a feature of the invention the boron or oxygen or a mixture thereof is added to the Mo-Ti alloy in concentrations between 0.01 to 5 w/o (weight percent). The preferred concentration is from 0.025 to 0.5 w/o boron or 0.1 to 2.5 w/o oxygen.

Any way of introducing the oxygen or boron to the Mo-Ti blend is suitable if the intended concentration is maintained. For examples oxygen can be added as powdered $TiO_2$, as an existing oxide layer on the surface of the Mo and Ti powder particles, or by intentionally oxidizing the powders on a compact. Boron can be added as elemental boron, Ti boride or Mo boride powder.

The molybdenum and titanium may be provided in the form of −325 mesh powder. The starting powders including the sintering aid with the appropriate concentrations are mixed and pressed into a suitable shape called a compact. Pressing pressures of 80 kpsi (551 megapascals) is satisfactory, but a wide range is possible. The compact may then be directly sintered, or presintered for alloying and then reground to a powder suitable for final sintering. Both presintering and sintering steps are done in an inert atmosphere. In the case of direct sintering, hermetic samples were obtained by sintering at 1900° C. with either boron or oxygen without metallic additives.

Metallic sintering aids such as 1 w/o nickel (Ni), cobalt (Co), or copper (Cu) may also be added to further reduce sintering temperature. Hermetic samples were obtained by sintering at temperatures as low as 1700° C. if a metallic additive (e.g., Ni) was also used.

In the following examples a Mo to Ti w/o ratio of 2.96 was used.

EXAMPLE I 0.5 w/o of boron powder was added to an elemental powder blend. The mixture was pressed and heated at 1900° C. for 4.5 hours. The resultant member had a density of 7.00 g/cm$^3$ and was found to be hermetic.

EXAMPLE II

An elemental powder blend of Mo and Ti was presintered at 1700° C. for 0.5 hour. The resultant alloy was powdered to −325 mesh alloyed powder. 0.25 w/o boron was added and the mixture was pressed and heated at 1900° C. for 5 hours. The resulting member had a density of 7.19 g/cm$^3$ and was found hermetic.

EXAMPLE III

Example II was repeated using 0.5 w/o boron. The resulting member had a density of 7.21 g/cm$^3$ and was hermetic.

EXAMPLE IV

A −325 mesh alloyed Mo-Ti powder with 2.19 w/o of oxygen in the form of a surface oxide was pressed and sintered at 1900° C. for 0.5 hour. The resulting member had a density of 7.13 g/cm$^3$ and was hermetic.

EXAMPLE V 2.13 w/o of oxygen as a surface oxide and 1 w/o of nickel were added to an elemental blend of Mo-Ti. The mixture was pressed and heated at 1700° C. for 0.5 hour. The resulting member had a density of 6.94 g/cm$^3$ and was hermetic.

EXAMPLE VI 2.13 w/o oxygen as a surface oxide and 1.0 w/o nickel was added to an elemental blend of Mo and Ti. The mixture was pressed and heated at 1900° C. for 0.5 hour. The resulting member had a density of 7.19 g/cm$^3$ and was hermetic.

EXAMPLE VII

Example VI was repeated but with 1.12 w/o oxygen. The resulting member had a density of 7.18 g/cm$^3$ and was hermetic.

EXAMPLE VIII 2.40 w/o of oxygen as $TiO_2$ powder and 1 w/o nickel was added to an elemental powder blend of Mo-Ti. The mixture was pressed and heated at 1700° C. for 0.5 hour. The resulting member had a density of 6.97 and was hermetic.

Density measurements on all hermetic samples were made by Archemedian analysis performed on an analytical balance. Samples were deemed hermetic if they had a leak rate below that detectable with an He leak detector. Oxygen concentrations were determined by neutron activation analysis or a weight gain measurement.

Some advantages of using boron or oxygen as sintering aids are: (1) The second phase, formed in minor quantities when sintering Mo-Ti alloys has thermal expansion coefficients which are comparable with the thermal expansion coefficients of Mo-Ti solid solutions, and are therefore less active as stress raisers; (2) The non-metallic additions permit sintering to hermeticity directly from the elemental starting powders; and (3) Non-metallic additives improve the sinterability of Mo-Ti with metallic additives without presintering.

It is seen that the addition of oxygen or boron significantly improve the sinterability of Mo-Ti alloys, both with and without metallic additions. These additions react with Ti in the Mo-Ti alloy to form $Ti_2O$, TiO, or TiB, all of which have thermal expansion coefficients that are less than those of $Ti_2Ni$, $Ti_2Co$, or $Ti_2Cu$, and are more comparable with those of Mo-Ti solid solutions.

While there has been shown and described what is at present considered the preferred embodiment of the invention, it will be obvious to those skilled in the art that various changes and modifications may be made therein without departing from the scope of the invention as defined by the appended claims.

We claim:

1. A member having an approximately uniform thermal expansion coefficient, said member sintered from a mixture comprised of molybdenum in the form of approximately −325 mesh powder, titanium in the form of approximately −325 mesh powder, and, as a sintering aid, 0.01 to 5 weight percent of oxygen in the form of oxide or boron or mixtures thereof.

2. The member of claim 1 wherein said sintering aid is approximately 0.025 to 0.5 weight percent boron.

3. The member of claim 1 wherein said sintering aid is approximately 1 to 2.5 weight percent oxygen.

4. The member of claim 1 which further includes approximately 1 weight percent of nickel, cobalt, copper, or mixtures thereof.

5. The member of claim 4 wherein said sintering aid is approximately 0.025 to 0.5 weight percent boron.

6. The member of claim 4 wherein said sintering aid is approximately 1 to 2.5 weight percent oxygen.

7. A method of manufacturing a member having an approximately uniform thermal expansion coefficient, comprising the steps of:

providing molybdenum in the form of approximately −325 mesh powder;

providing titanium in the form of approximately −325 mesh powder;

providing approximately 0.01 to 5 weight percent of oxygen in the form of oxide, or boron, or a mixture thereof;

mixing the foregoing components in an inert atmosphere;

pressing the resulting mixture into a desired shape; and heating the pressed mixture in an inert atmosphere to a temperature sufficient to sinter said mixture.

8. The method of claim 7 wherein approximately 0.025 to 0.5 weight percent of boron is provided.

9. The method of claim 7 wherein said boron is provided in the form of elemental boron.

10. The method of claim 7 wherein said boron is provided in the form of Ti boride.

11. The method of claim 7 wherein said boron is provided in the form of Mo boride.

12. The method of claim 7 wherein approximately 1 to 2.5 weight percent of oxygen is provided.

13. The method of claim 7 wherein said oxygen is provided in the form of an oxide on the surface of said powdered titanium or molybdenum.

14. The method of claim 7 wherein said oxygen is provided in the form as titanium dioxide.

15. The method of claim 7 in which there is also provided prior to sintering approximately 1 weight percent of nickel, cobalt, copper, or mixtures thereof.

16. The method of claim 15 wherein approximately 0.025 to 0.5 weight percent of boron is provided.

17. The method of claim 15 wherein said boron is provided in the form of elemental boron.

18. The method of claim 15 wherein said boron is provided in the form of Ti boride.

19. The method of claim 15 wherein said boron is provided in the form of Mo boride.

20. The method of claim 15 wherein approximately 1 to 2.5 weight percent of oxygen is provided.

21. The method of claim 15 wherein said oxygen is provided in the form of an oxide on the surface of said powdered titanium or molybdenum.

22. The method of claim 15 wherein said oxygen is provided in the form of titanium dioxide.

23. A sealed assembly comprised of a ceramic tube having two ends;

at least one member hermetically sealed to one of asid ends, said member a sintered composition of molybdenum in the form of approximately −325 mesh powder, titanium in the form of approximately −325 mesh powder, and approximately 0.01 to 5 weight percent of oxygen in the form of oxide, or boron, or mixtures thereof.

24. The sealed assembly of claim 23 wherein said sintering aid is approximately 0.025 to 0.5 weight percent boron.

25. The sealed assembly of claim 23 wherein said sintering aid is approximately 1 to 2.5 weight percent oxygen.

26. The sealed assembly of claim 23 which further includes approximately 1 weight percent of nickel, cobalt, copper, or mixtures thereof.

27. The sealed assembly of claim 26 wherein said sintering aid is approximately 0.025 to 0.5 weight percent boron.

28. The sealed assembly of claim 26 wherein said sintering aid is approximately 1 to 2.5 weight percent oxygen.

* * * * *